United States Patent [19]

Parker, III

[11] 4,011,610

[45] Mar. 15, 1977

[54] BEDPAN SYSTEM

[76] Inventor: John Castlereagh Parker, III, 2127 Philomene, Lincoln Park, Mich. 48146

[22] Filed: Nov. 10, 1975

[21] Appl. No.: 630,163

[52] U.S. Cl. ..... 5/90; 4/113; 5/91

[51] Int. Cl.[2] ..... A61G 7/02

[58] Field of Search ..... 4/112, 113; 5/90, 91

[56] References Cited

UNITED STATES PATENTS

| | | | |
|---|---|---|---|
| 1,286,516 | 12/1918 | Bowron | 5/90 |
| 2,615,175 | 10/1952 | Corakas | 5/90 |
| 3,362,031 | 1/1968 | Lemly | 5/91 |
| 3,849,811 | 11/1974 | LaCyll | 5/90 |

*Primary Examiner*—Casmir A. Nunberg
*Attorney, Agent, or Firm*—Everett R. Casey

[57] ABSTRACT

A complete bedpan system in which a mattress is apertured to accept a bedpan assembly, the bedpan being provided with a disposable liner to fully cover the surfaces engaged during usage and with the mouth of the liner being trapped between interengaging lips on the bedpan and on the mattress, hand-pocket recesses being provided to facilitate that trapping, with a sheet having a central aperture and a cuff to line and protect the aperture in the mattress, the cuff being trapped between the mattress and the bedpan, with a mattress plug to resiliently cover the bedpan when not in use, and provided with a rigid supporting base designed to center the plug with respect to the aperture in the mattress, and with an anti-contamination supporting plate underlying the mattress and the bedpan and serving to control the position of the bedpan relative to the springs and hence to control the position of the mattress relative to the springs.

14 Claims, 6 Drawing Figures

BEDPAN SYSTEM

BRIEF SUMMARY OF THE INVENTION

The present invention has resulted from an effort to reduce the discomfort, unpleasantness, and unsatisfactoriness of conventional bedpans, and reflects an effort to create a total bedpan system which is physiologically and psychologically more acceptable to the patient, which is practically and psychologically more acceptable to the nursing and orderly staff, which relieves concerns by the physicians as to undue stresses to which the patient may be subjected during the use of normal bedpans, and which can be adapted, with feasible investment, to existing hospital beds and the like.

DETAILED DESCRIPTION

Figure 1:
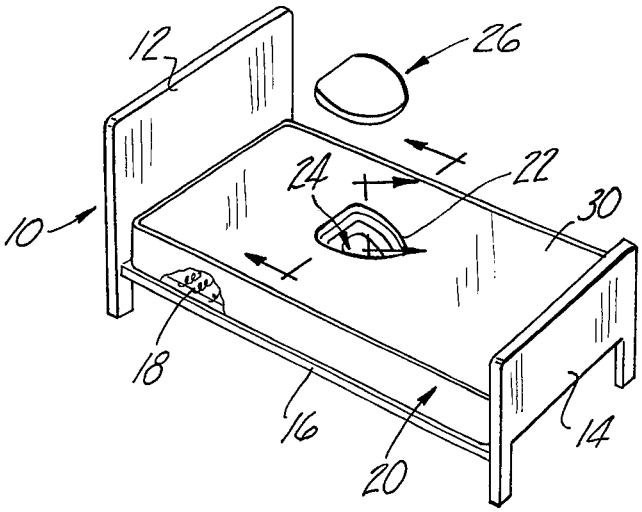
FIG. 1 is a perspective view of a simplified bed, representative of a hospital bed or the like, incorporating the bedpan system which is the subject of the present invention, with the mattress plug being illustrated in an elevated position for clarity of understanding.

The schematically and simplified bed 10 illustrated in FIG. 1 of the drawings is intended to represent any of a variety of conventional and available hospital bed structures. The illustrated bed comprises a headboard 12, a footboard 14, siderail structure including element 16, and a spring assembly 18. The system is applicable to both manually and electrically operable beds and is contemplated for use with flat beds or with plural-section beds in which a head section and a foot section may be separately manipulated relative to an intermediate section. In the latter case the bedpan itself is preferably positioned in that intermediate section, and the bedpan can be used with the patient either in a sedentary or a supine position.

Spring assembly 18 is surmounted by a mattress assembly 20 having an aperture 22 for accepting a bedpan assembly 24 recessed therewithin, the recess being selectively closable by a plug assembly 26. While aperture 22 is illustrated medially of the width of the bed, in some practices, it may be deemed advantageous to offset it laterally to facilitate making of an occupied bed.

The mattress 20 preferably is manufactured of foamed material 28 (FIG. 2) and it is enclosed in a suitable mattress cover 30, preferably of the specialized nature frequently employed for hospital use. Cover 30 is provided with an integral cuff portion 32 (FIGS. 2 and 5) projecting circumferentially of and through the aperture 22 to completely enclose the mattress. Details of the construction of the wall of the aperture 22 will be set forth hereinafter.

Figure 2:
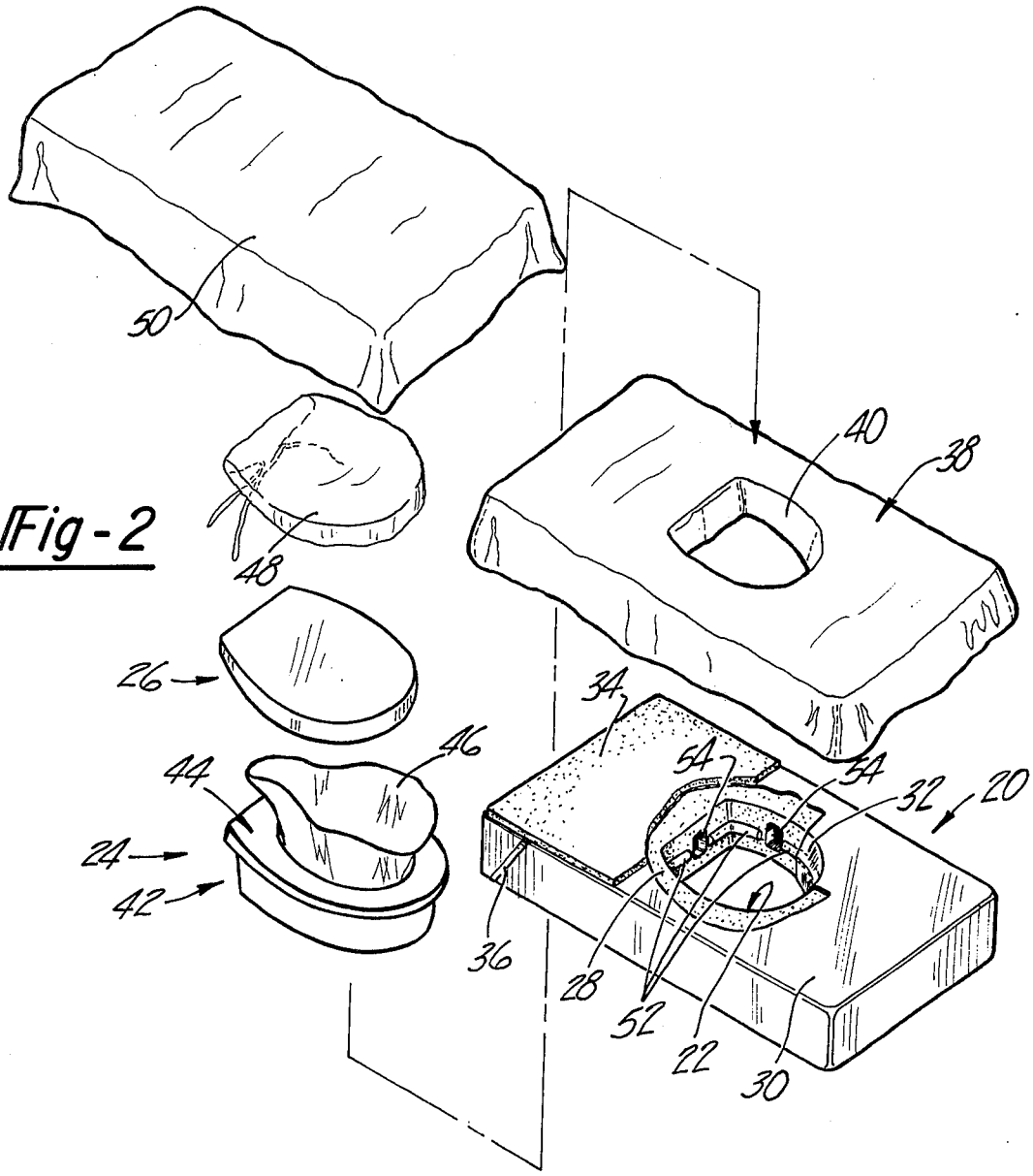
FIG. 2 is an exploded perspective view of elements of the bedpan system which is the subject of this invention.

Mattress 20, situate upon springs 18, may be covered in whole or in part with a mattress pad, if desired. FIG. 2 illustrates a short mattress pad 34 disposed on the head end of the mattress and extending down substantially to the beginning of the aperture 22, and held in place on the mattress by means such as loops 36. A corresponding short pad may be provided at the foot end of the bed, if desired, or a single large pad with a suitable cut out aligned with aperture 22 may be employed.

Bottom sheet 38 (FIG. 2) overlays the mattress (and the mattress pad, if provided). Bottom sheet 38 may be and preferably is a "contoured" sheet so as to be self-positioning, self-retaining and self-tauting.

Sheet 38 is provided with an aperture disposed to align with the aperture 22 in the mattress 20, and is provided with an integral (folded or sewed or both) depending cuff 40 (FIGS. 2 and 5) to cover the cuff 32 of the mattress cover fully circumferentially of the aperture and over at least the major portion of the height of the aperture 22.

The bedpan assembly, comprising a pan portion 42 and a seat portion 44, is insertable through the cuffed aperture in lower sheet 38 into the aperture 22 is the mattress assembly 20. A disposable flexible plastic bag 46 (which may be of conventional form, having a closed bottom) is disposable within the pan 42, with the mouth portion of that bag projecting upwardly through the central aperture in the seat portion 44. That mouth portion is deflected over the seat portion 44 to provide full sanitary protection in a manner to be described hereinafter.

The mattress plug 26 (FIG. 2), a rigidified, resilient, protectively covered member, conforms to and is insertable within the aperture in the lower sheet 38 to rest upon the seat portion 44 of the bedpan assembly 24, with the top surface thereof essentially flush with the surface of the sheet 38. A covering sheet 48 may be tied or otherwise secured upon the mattress plug 26. Top sheet 50 may then be placed upon the bed covering all of the previously noted elements.

Figure 3:
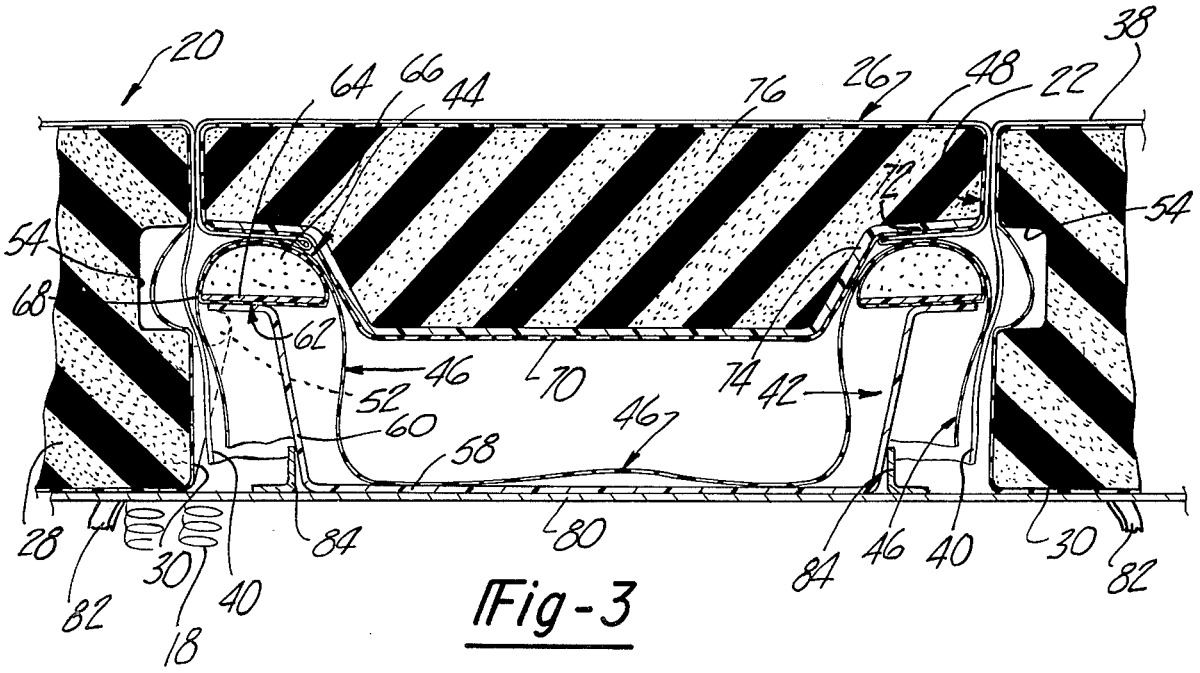
FIG. 3 is a sectional view taken substantially along the line 3—3 of FIG. 1.
Figure 4:
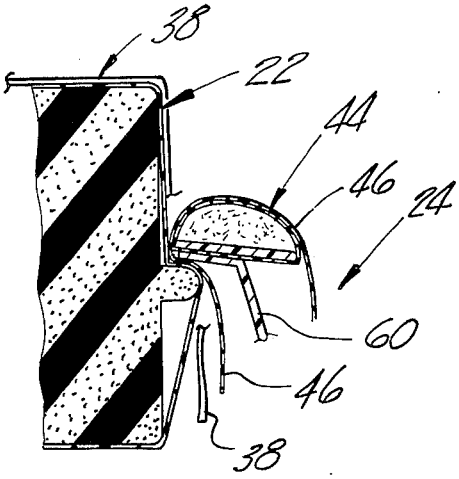
FIG. 4 is a fragmentary sectional view taken substantially along the line 4—4 of FIG. 1.
Figure 5:
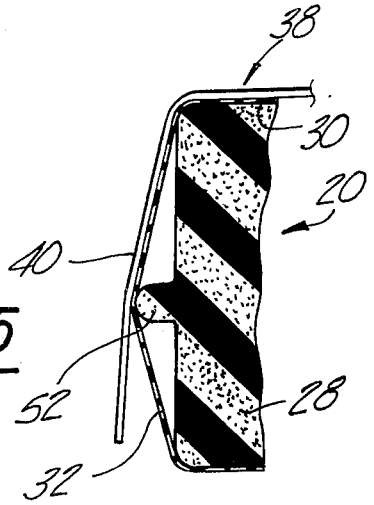
FIG. 5 is a fragmentary sectional view showing the coaction of certain of the elements of the system, with the bedpan removed from the mattress.

As may best be seen in FIGS. 3, 4 and 5, the aperture 22 in the mattress 20 is preferably majorly cylindrical, that is, in a surface defined by moving one straight line in a path parallel with another. The aperture is preferably generally ovoid in cross section, with the projecting narrowed portion directed towards the foot of the bed. If desired, the wall defining the upper portion of aperture 22 may be chamfered or sloped (with a corresponding chamfer or slope of the mating surface of the plug 26), but the illustrated arrangement is preferred.

Approximately medially of the height of the aperture 22 a plurality of discrete flexible segments 52 are disposed in alignment around the periphery of the aperture 22. These segments are desirably of the same or substantially the same foam material as the remainder of the mattress and are either formed integrally therewith during molding or are secured thereto subsequently such as by the use of an adhesive. Each segment is illustrated to be generally ogive in cross section, which is the presently preferred shape. As will be seen, the segments constitute elements of a lip means the upper face of which serves as a shoulder to perform certain functions, and as a result, the lower portion of the segments may be of any suitable selected shape and may, if desired, extend to the level of the bottom of the mattress.

As may best be seen in FIG. 2 of the drawings, the segments 52 are aligned so as to form a lip or shoulder extending around the periphery of the aperture 22. However, the segments are interrupted at a plurality of locations by a plurality of hand pocket recesses 54. In the preferred arrangement, a recess 54 is located on the forward and rearward faces of the recess 22, as well as on each side wall thereof. Each such recess is of a size to accommodate a person's hand and extends downwardly at least to the level of the lip means 52 for a purpose to be described.

The bedpan assembly 24 comprises a pan portion 42 illustrated as having a flat bottom 58, and tapered side walls 60. The side walls terminate in an outwardly directed generally horizontal flange portion 62 extending peripherally of the entire pan structure. The pan may be made of metal, or preferably, of relatively rigid plastic material. The toilet seat is illustrated to be of conventional ovoid shape but may be of different configuration if desired including the known generally key-hole shape. Seat portion 44 has, or may have, a reinforcing plate 64 surmounted by a resilient foam cushion portion 66, together with, desirably, an integral outer casing 68 serving to encase the entire seat structure. The seat is firmly secured to the pan 24 in any suitable manner. It is preferred that a good seal be established between those two elements, such as through the use of an appropriate adhesive, to prevent any leakage between the pan and the seat, and to preclude germ cavities.

The outer peripheral size of the seat is preferably approximately the same as the outer peripheral size of the flange 62, and is but slightly smaller than the aperture 22 so that the outer edge of the seat lies closely adjacent the wall defining the aperture 22.

The mattress plug 26 comprises a support plate 70 desirably of a rigid plastic material. Support plate 70 includes a depressed central portion, an outwardly projecting flange 72 and an intermediate tapered wall portion 74. Foam material 76 is supported on the plate 70 and the entire plug is preferably covered with a mattress cover corresponding to that above described with reference to mattress cover 30.

When the plug 26 is in position, as illustrated in FIG. 3, the weight of the plug and of any weight thereon, (such as a portion of the patient's body) is transferred through the flange 72 to the seat of the bedpan assembly. The tapered wall portion 74 is of a size and taper to either abut or lie closely proximate to the inner surface of the seat portion of the bedpan assembly so that the bedpan assembly centers the plug and locates its position.

As previously noted, the mattress 20 rests upon a spring assembly including springs 18. In the preferred arrangement, a rigid plate 80, which may be of plastic, is disposed between the mattress 20 and the springs 18, and is preferably larger in size than the aperture 22, so as to underlie a portion of the mattress itself, and so as to protect the springs 18 from contamination in the event of inadvertant spillage. Means such as clips 82 are secured to plate 80 and serve as a means to secure the plate in position on the springs 18. Brackets 84 are provided integral with the plate 80 (either by securing separate brackets thereon or by forming the same therein during molding of the plate 80). Brackets 84 are provided in a number and at locations to locate and position the bedpan assembly 24 with reference to the plate 80. It is contemplated, for example, that four such brackets be spaced around the pan 42. Since plate 80 is secured in position with respect to springs 18 by clips 82, the brackets 84 serve to establish the position of bedpan assembly 24 with respect to the springs. Hence the bedpan assembly tends to maintain the position of the mattress assembly 20 on the bedsprings both because of the engagement between the mattress plug 26 and the mattress 20, the plug being fixed in position by the bedpan assembly 24, and because of the engagement between the wall of the aperture 22 and the seat of the bedpan assembly 24.

With the plug 26 removed, the plastic disposable container 46 is inserted within the pan portion of the bedpan assembly in approximately the location illustrated in dot dash lines in FIG. 3 of the drawings. The mouth of the disposable container is then trained over the exterior of the seat and downwardly towards the narrow gap between the outer periphery of the seat and the adjacent wall of the aperture 22. At that point, the mouth of the plastic disposable container may be forced further by placing the hands into the hand pocket recesses 54 and then pressing the bag inwardly between the flange or lip means 62 and the upper surfaces of the lips 52, the bedpan assembly 24 normally being slightly elevated during that manipulation. The mouth portion of the container 46, after installation, is trapped and pinched between the undersurface of the lip means 62 and the upper surfaces of the lip means 52, to prevent inadvertant or rubbing removal of the bag, as is best illustrated in FIG. 4 of the drawings.

In order to obtain a good pinch effect to retain the disposable plastic bag in position, it is preferred that the segments 52 be vertically located such that at least a small portion of the weight of the bedpan assembly 24 is supported thereby, rather than the assembly being supported entirely by the plate 80.

Figure 6:
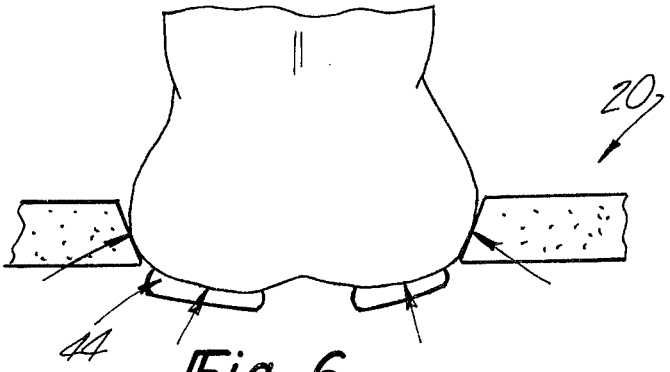
FIG. 6 is a schematic illustration of forces exerted by the mattress and by the seat of the bedpan during the use of the system by the patient.

With the upper surface of the seat portion of the bedpan assembly 24 recessed downwardly from the surface of the mattress 20, the upper portion of the wall of the mattress 20 defining the aperture 22 can contribute to assisting in the positioning of the patient relative to the seat of the bedpan assembly 24, assisting to properly center the patient thereon. Further, those portions of the mattress will or can be deflected by the outer portions of the patient's buttocks, hips and thighs so that supporting forces for the patient are exerted not only through the seat of the bedpan assembly 24 but also through the portions of the mattress 20 at the upper portion of aperture 22, as is illustrated in FIG. 6 of the drawings.

The mattress will, of course, also tend to exert a positioning effect upon the patient in a fore and aft sense.

It will be appreciated that various variations and modifications are within the scope of the invention. For example, it is contemplated that the wall 60 of the pan 42 may be somewhat enlarged, with flange 62 being directed inwardly, in which case the overlying undersurface of the seat 44 would serve as the lip means.

What is claimed is:

1. In a bedpan system for use with hospital beds or the like, a foam mattress having a wall portion defining an aperture therein open at the upper surface of the mattress and projecting thereinto, a bedpan assembly comprising a pan portion and a seat portion and insertable into the aperture in said mattress with the seat portion disposed below the level of the upper surface of said mattress, a disposable flexible bag having a closed lower portion insertable through said seat portion into said pan portion and a mouth portion flexible over said seat portion, means for aiding in the support of said bedpan assembly in said aperture, said seat portion having a wall portion defining a central opening which opens into said pan portion, and a selectively removable mattress plug substantially conforming in peripheral shape to the shape of the aperture in said mattress and substantially conforming in height to the distance between said bedpan assembly and the upper surface of the mattress, and insertable in said aperture in a position to rest on said seat portion and present an upper surface substantially coplanar with the upper surface of said mattress, said mattress plug comprising a rigid base member having a depending central portion, an outer peripheral flange and a depending wall portion between said central portion and said flange, said plug peripheral flange overlying the upper surface of said seat portion and transferring the weight of said plug and of any weight on said plug to said upper surface of said seat, said plug wall portion depending within the opening in said seat portion and being closely adjacent to said wall portion of said seat portion to control the lateral position of said plug relative to the surface of said mattress.

2. The combination of claim 1 in which said mattress plug further includes a foam material supported on said base member, and a cover enclosing the entire mattress plug and engageable with said seat portion.

3. In a bedpan system for use with hospital beds or the like having a bedspring assembly, a foam mattress having a wall portion defining an aperture therein open at the upper surface of the mattress and projecting therethrough, a bedpan assembly comprising a pan portion and a seat portion and insertable into the aperture in said mattress with the seat portion disposed below the level of the upper surface of said mattress, a disposable flexible bag having a closed lower portion insertable through said seat portion into said pan portion and a mouth portion flexible over said seat portion, a relatively rigid plate larger in size than the aperture in said mattress and disposable between the bedspring assembly and the mattress, means for securing said plate to the bedspring assembly, the bottom of said bedpan assembly being restible on said plate, and means for assisting to maintain said mattress in position on the bedspring assembly comprising flange means on said plate engageable with lateral surfaces of said bedpan assembly for positioning said bedpan assembly with respect to said plate, the engagement between said bedpan assembly and said wall of said mattress assisting to position said mattress with respect to said bedpan assembly.

4. The combination of claim 3 in which said plate further shields the bedspring assembly from contamination in the event of accident in the use of the bedpan assembly.

5. In a bedpan system for use with hospital beds or the like, a foam mattress having a wall portion defining an aperture therein open at the upper surface of the mattress and projecting thereinto, said wall portion having a generally cylindrical portion, inwardly directed lip means on said generally cylindrical portion of said wall portion of said mattress and spaced below the upper surface of said mattress, a bedpan assembly comprising a pan portion and a seat portion and outwardly directed lip means and insertable into the aperture in said mattress with at least portions of said lip means on said bedpan assembly closely overlying at least portions of said lip means on said mattress, and a disposable flexible bag having a closed lower portion insertable through said seat portion into said pan portion and a mouth portion flexible over said seat portion and pinchable between said lip means on said bedpan assembly and said lip means on said mattress, said inwardly directed lip means on said mattress comprising a plurality of discrete, spaced-apart segments having substantially coplanar upper surfaces, and further including a cavity formed in said wall of said mattress between each of at least certain of the pairs of adjacent ones of said segments, each of said cavities being of sufficient size to permit and facilitate manual insertion and tucking of the mouth portion of said flexible bag around the exterior of said seat portion of said bedpan assembly and between said lip means on said bedpan assembly and said lip means on said mattress.

6. In a bedpan system for use with hospital beds or the like, a foam mattress having a wall portion defining an aperture therein open at the upper surface of the mattress and projecting thereinto, said wall portion having a generally cylindrical portion, inwardly directed lip means on said generally cylindrical portion of said wall portion of said mattress and spaced below the upper surface of said mattress, a bedpan assembly comprising a pan portion and a seat portion and outwardly directed lip means and insertable into the aperture in said mattress with at least portions of said lip means on said bedpan assembly closely overlying at least portions of said lip means on said mattress, and a disposable flexible bag having a closed lower portion insertable through said seat portion into said pan portion and a mouth portion flexible over said seat portion and pinchable between said lip means on said bedpan assembly and said lip means on said mattress, and further including a sheet for said mattress having an aperture alignable with the aperture in said mattress and an integral cuff covering said wall portion of said mattress and disposable within the aperture in said mattress, and in which portions of said cuff are also pinched between said lip means on said bedpan assembly and said lip means on said mattress.

7. In a bedpan system for use with hospital beds or the like, a foam mattress having a wall portion defining an aperture therein open at the upper surface of the mattress and projecting thereinto, said wall portion having a generally cylindrical portion, inwardly directed lip means on said generally cylindrical portion of said wall portion of said mattress and spaced below the upper surface of said mattress, a bedpan assembly comprising a pan portion and a seat portion and outwardly directed lip means and insertable into the aperture in said mattress with at least portions of said lip means on said bedpan assembly closely overlying at least portions of said lip means on said mattress, and a disposable flexible bag having a closed lower portion insertable through said seat portion into said pan portion and a mouth portion flexible over said seat portion and pinchable between said lip means on said bedpan assembly and said lip means on said mattress, said pan portion having an upper peripheral lip, said seat portion being integrally sealed to said peripheral lip.

8. The combination of claim 7 in which said seat portion is of a resilient material.

9. The combination of claim 8 in which said seat portion is less compressible than said foam mattress and in which portions of said mattress adjacent said wall provide lateral support and centering forces for the patient during use of the system.

10. In a bedpan system for use with hospital beds or the like, a foam mattress having a wall portion defining an aperture therein open at the upper surface of the mattress and projecting thereinto, said wall portion having a generally cylindrical portion, inwardly directed lip means on said generally cylindrical portion of said wall portion of said mattress and spaced below the upper surface of said mattress, a bedpan assembly comprising a pan portion and a seat portion and outwardly directed lip means and insertable into the aperture in said mattress with at least portions of said lip means on said bedpan assembly closely overlying at least portions of said lip means on said mattress, and a disposable flexible bag having a closed lower portion insertable through said seat portion into said pan portion and a mouth portion flexible over said seat portion and pinchable between said lip means on said bedpan assembly and said lip means on said mattress, said inwardly directed lip means on said mattress comprising a plurality of discrete, spaced-apart segments having substantially coplanar upper surfaces, said seat portion having a wall portion defining a central opening which opens into said pan portion, and further including a selectively removable mattress plug substantially conforming in peripheral shape to the shape of the aperture in said mattress, and substantially conforming in height to the distance between said bedpan assembly and the upper surface of the mattress and insertable in said aperture in a position to rest on said seat portion and present an upper surface substantially coplanar with the upper surface of said mattress.

11. The combination of claim 10 in which said mattress plug comprises a rigid base member having a depending central portion, an outer peripheral flange and a depending wall portion between said central portion and said flange, said plug peripheral flange overlying the upper surface of said seat portion and transferring the weight of said plug and of any weight on said plug to said upper surface of said seat, said plug wall portion depending within the opening in said seat portion and being closely adjacent to said wall portion of said seat portion to control the lateral position of said plug relative to said mattress.

12. The combination of claim 11 in which said mattress plug further includes a foam material supported on said base member, and a cover enclosing the entire mattress plug and engageable with said seat portion.

13. In a bedpan system for use with hospital beds or the like, a foam mattress having a wall portion defining an aperture therein open at the upper surface of the mattress and projecting thereinto, said wall portion having a generally cylindrical portion, inwardly directed lip means on said generally cylindrical portion of said wall portion of said mattress and spaced below the upper surface of said mattress, a bedpan assembly comprising a pan portion and a seat portion and outwardly directed lip means and insertable into the aperture in said mattress with at least portions of said lip means on said bedpan assembly closely overlying at least portions of said lip means on said mattress, and a disposable flexible bag having a closed lower portion insertable through said seat portion into said pan portion and a mouth portion flexible over said seat portion and pinchable between said lip means on said bedpan assembly and said lip means on said mattress, said inwardly directed lip means on said mattress comprising a plurality of discrete, spaced-apart segments having substantially coplanar upper surfaces, said mattress being adapted to be supported on a bedspring assembly, said aperture in said mattress extending through the mattress, and further including a relatively rigid plate larger in size than the aperture in said mattress and disposable between the bedspring assembly and the mattress, means for securing said plate to the bedspring assembly, the bottom of said bedpan assembly being restable on said plate, and means for assisting to maintain said mattress in position on the bedspring assembly comprising flange means on said plate engageable with lateral surfaces of said bedpan assembly for positioning said bedpan assembly with respect to said plate, the engagement between said bedpan assembly and said wall of said mattress assisting to position said mattress with respect to said bedpan assembly.

14. In a bedpan assembly for use with hospital beds or the like, a foam mattress having a wall portion defining an aperture therein open at the upper surface of the mattress and projecting thereinto, a bedpan assembly comprising a pan portion and a seat portion and insertable into the aperture in said mattress with the seat portion disposed below the level of the upper surface of said mattress, a disposable flexible bag having a closed lower portion insertable through said seat portion into said pan portion and a mouth portion flexible over said seat portion, and a sheet for said mattress having an aperture alignable with the aperture in said mattress and an integral cuff around and projecting from said aperture covering said wall portion of said mattress and disposable within the aperture in said mattress, portions of said cuff lying and being trapped between said bedpan assembly and said mattress.

* * * * *